US005762221A

United States Patent [19]

Tobias et al.

[11] Patent Number: 5,762,221

[45] Date of Patent: Jun. 9, 1998

[54] HOT-FILLABLE, BLOW-MOLDED PLASTIC CONTAINER HAVING A REINFORCED DOME

[75] Inventors: John W. Tobias, Lancaster; Richard Ogg, Littlestown, both of Pa.

[73] Assignee: Graham Packaging Corporation, York, Pa.

[21] Appl. No.: 685,042

[22] Filed: Jul. 23, 1996

[51] Int. Cl.[6] ..... B65D 8/12

[52] U.S. Cl. ..... 215/381; 215/382; 220/606

[58] Field of Search ..... 215/381, 382, 215/398, 383; 220/606, 608, 604

[56] References Cited

U.S. PATENT DOCUMENTS

| | | | |
|---|---|---|---|
| D. 134,077 | 10/1942 | Clark | 215/383 |
| D. 189,372 | 11/1960 | Adell | 215/383 |
| D. 293,890 | 1/1988 | Rogler . | |
| D. 294,118 | 2/1988 | Papa . | |
| D. 294,120 | 2/1988 | Griesing et al. . | |
| D. 294,461 | 3/1988 | Papa . | |
| D. 294,463 | 3/1988 | Lang . | |
| D. 294,678 | 3/1988 | Papa . | |
| D. 294,679 | 3/1988 | Griesing et al. . | |
| D. 295,381 | 4/1988 | Papa . | |
| D. 295,609 | 5/1988 | Papa . | |
| D. 295,955 | 5/1988 | LeFevre . | |
| D. 316,968 | 5/1991 | York . | |
| D. 331,881 | 12/1992 | Garver et al. . | |
| D. 340,190 | 10/1993 | Skidmore et al. . | |
| D. 346,556 | 5/1994 | Sirico et al. . | |
| D. 347,391 | 5/1994 | Guertin . | |
| D. 366,416 | 1/1996 | Semersky . | |
| D. 366,417 | 1/1996 | Semersky . | |
| D. 366,421 | 1/1996 | Best . | |
| D. 366,831 | 2/1996 | Semersky . | |
| 3,033,404 | 5/1962 | Adell | 215/383 |
| 3,536,500 | 10/1970 | Cleereman et al. | 215/382 X |
| 4,805,788 | 2/1989 | Akiho . | |
| 4,818,575 | 4/1989 | Hirata et al. . | |
| 4,863,046 | 9/1989 | Collette et al. | 215/382 X |
| 4,946,053 | 8/1990 | Conrad . | |
| 5,056,674 | 10/1991 | Swartley | 215/382 |
| 5,067,622 | 11/1991 | Garver et al. . | |
| 5,165,557 | 11/1992 | Ota et al. | 215/383 |
| 5,178,290 | 1/1993 | Ota et al. . | |
| 5,199,588 | 4/1993 | Hayashi . | |
| 5,222,615 | 6/1993 | Ota et al. . | |
| 5,224,614 | 7/1993 | Bono et al. | 215/398 X |
| 5,238,129 | 8/1993 | Ota . | |
| 5,310,068 | 5/1994 | Saghri . | |

*Primary Examiner*—Stephen J. Castellano
*Attorney, Agent, or Firm*—Howson and Howson

[57] ABSTRACT

A hot-fillable, blow-molded plastic container having a reinforced dome which controls dome distortion otherwise caused by forces associated with hot-filling and shipping. In one embodiment, the reinforced dome resists distortion, and in a second embodiment, the reinforced dome enhances ovalization distortion. The container dome is bell-shaped with an inwardly extending waist and has a plurality of vertically extending grooves passing through the waist. Each groove is inwardly concave and extends from below the waist to adjacent the finish. Arcuate lands are formed between the grooves, and optionally, can have panels with a textured pattern which add to the aesthetic appearance of the container and which provide further stiffening of the dome. When two grooves are utilized, ovalization distortion is enhanced, and when three or more grooves are utilized, distortion is prevented.

17 Claims, 4 Drawing Sheets

FIG. 2
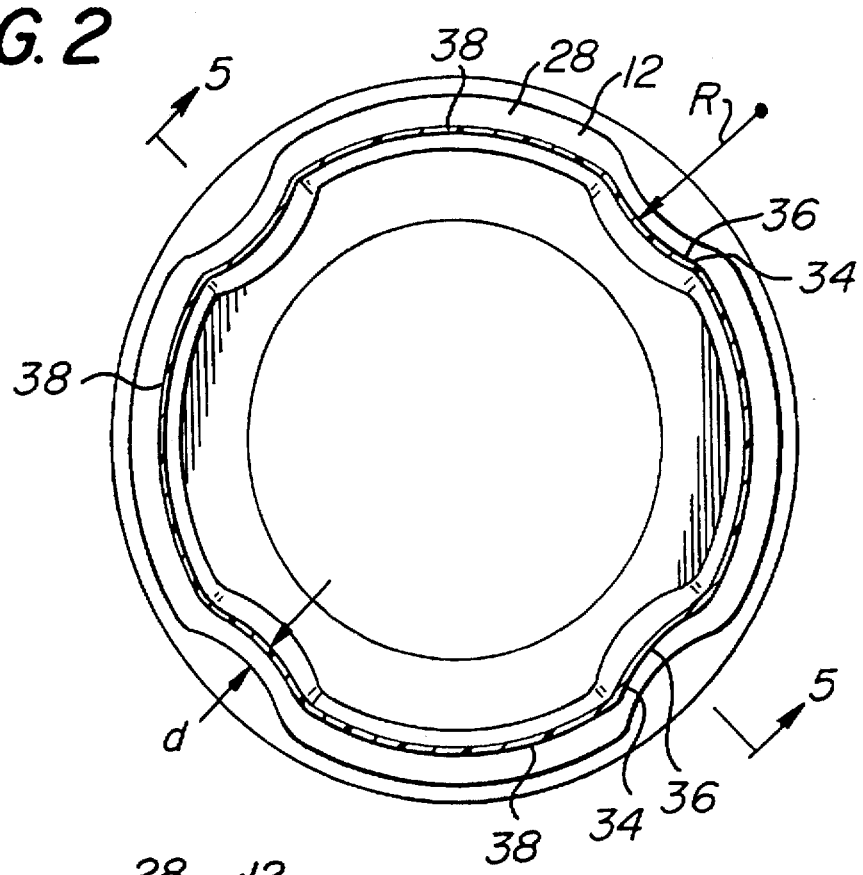
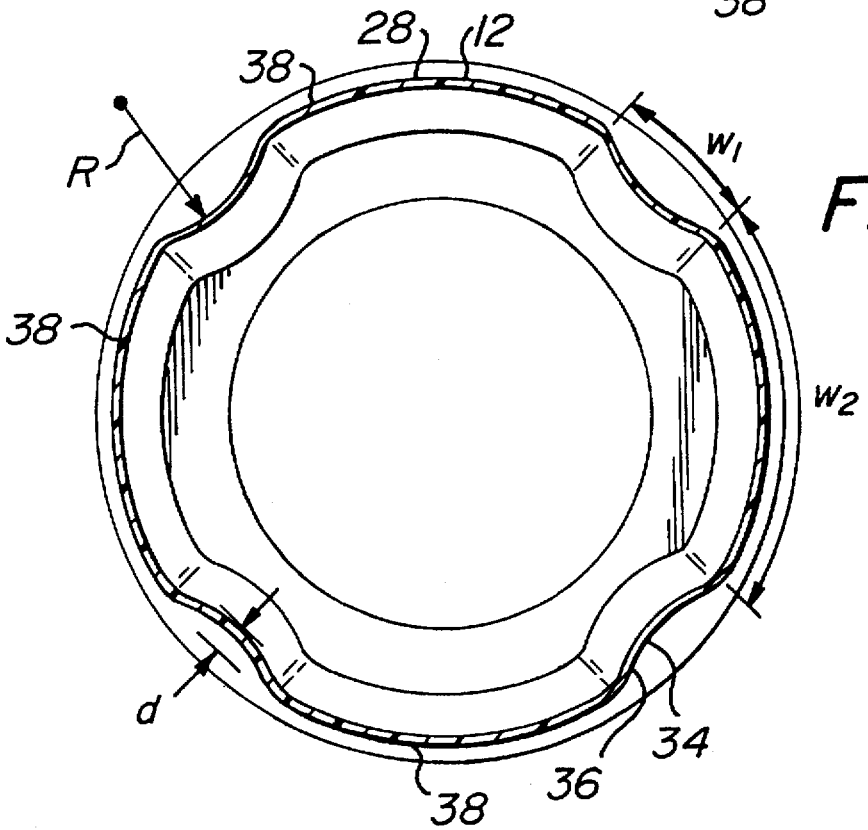
FIG. 3

HOT-FILLABLE, BLOW-MOLDED PLASTIC CONTAINER HAVING A REINFORCED DOME

FIELD OF THE INVENTION

The present invention relates to a blow-molded plastic container specifically designed to package beverages hot-filled into the container, and more particularly, the present invention relates to a blow-molded container having a reinforced dome which maintains its intended shape and withstands internal pressures exerted by hot-fill processing and external forces from packing, transporting and handling.

BACKGROUND OF THE INVENTION

Blow-molded plastic containers have become commonplace in packaging beverages and other liquid, gel, or granular products. Studies have indicated that the configuration and overall aesthetic appearance of a blow-molded plastic container can affect some consumer purchasing decisions. For instance, a dented, distorted or otherwise unaesthetic appearing container may provide the basis for some consumers to purchase a different brand of product which is packaged in an aesthetically pleasing manner.

While a container in its as-designed configuration may provide an appealing appearance when it is initially removed from blow-molding machinery, many forces act subsequently on, and alter, the as-designed shape from the time it is blow-molded to the time it is placed on a shelf in a store. Plastic containers are particularly susceptible to distortion since they are continually being re-designed in an effort to reduce the amount of plastic required to make the container. While there is a savings with respect to material cost, the reduction of plastic can decrease container rigidity and structural integrity.

In the packaging of beverages, especially juice, blow-molded plastic PET containers are used in the so-called "hot-fill" process, i.e. filling the containers with beverages at an elevated temperature, sealing the containers, and then allowing the beverage to cool. Internal forces act on the container as a result of the hot-fill processing. Hot-fillable plastic containers must provide sufficient flexure to compensate for the changes of pressure and temperature, while maintaining structural integrity and aesthetic appearance. The flexure is most commonly addressed with vacuum flex panels positioned under a label below the dome.

External forces are applied to sealed containers as they are packed and shipped. Filled containers are packed in bulk in cardboard boxes, or plastic wrap, or both. A bottom row of packed, filled containers may support several upper tiers of filled containers, and potentially, several upper boxes of filled containers. Therefore, it is important that the container have a top loading capability which is sufficient to prevent distortion from the intended container shape.

Dome region ovalization is a common distortion associated with hot-fillable, blow-molded plastic containers. The dome is the upper portion of the container adjacent the finish. Some dome configurations are designed to have a horizontal cross-section which is circular in shape. The forces resulting form hot-filling and top loading can change the intended horizontal cross-sectional shape, for example, from circular to oval.

Examples of hot-fillable, blow-molded plastic containers which can withstand the above referenced forces and can maintain their as-designed aesthetic appearance are the containers disclosed in U.S. Design Pat. Nos. D.366,416, D.366,417, and D.366,831 all assigned to the assignee of the present application. The referenced design patents illustrate in phantom lines a "bell-shape" dome located between a finish and a label mounting area. The diameter of the horizontal cross-section through a bell-shaped dome increases as the dome extends downwardly from the finish. The dome diameter then decreases to an inwardly extending peripheral waist, and downwardly from the waist, the dome diameter increases before connecting with the label mounting area of the container. The bell-shape of the dome provides an aesthetic appearance as initially blow-molded, and it provides a degree of reinforcement against distortion of the dome, particularly ovalization types of distortion.

Other known containers have specific structures which provide dome reinforcement. U.S. Pat. No. 5,222,615 issued to Ota et al. discloses a container having a rectangular, horizontal cross-section with a dome and support panels to increase the strength of the container and compensate for unequal stretching of the container during blow-molding. U.S. Pat. No. 5,067,622 issued to Garver et al. discloses a hot-fillable PET container having support panels located below the waist of its bell-shaped dome to accommodate deformation due to the vacuum effect caused by hot-filling. U.S. Pat. No. 5,310,068 issued to Saghri discloses a collapsible container having panels spaced along the periphery of its dome. U.S. Pat. Nos. 5,238,129 and 5,178,290 issued to Ota et al.; 4,805,788 issued to Akiho; 5,199,588 issued to Hayashi; 4,946,053 issued to Conrad; and 4,818,575 issued to Hirata et al. also disclose the use of panels in the dome portion of a container.

Other known containers have dome structures primarily for providing an aesthetically-pleasing appearance. For instance, see U.S. Design Pat. Nos. D.294,188, D.294,461, D.294,678, D.295,381, and D.295,609 issued to Papa; D.294,120 and D.294,679 issued to Griesing et al.; D.293,890 issued to Rogler; D.294,463 issued to Lang; D.295,955 issued to LeFevre; D.346,556 issued to Sirico et al.; D.366,421 issued to Best; D.340,190 issued to Skidmore et al.; D.347,391 issued to Guertin, D.331,881 issued to Garver et al.; and D.316,968 issued to York.

Although various ones of the referenced containers having a specific dome configuration may function satisfactorily for their intended purposes, there is a need for a blow-molded plastic PET container having an improved reinforced dome which controls the amount of ovalization distortion due to hot-filling, and resists compressive distortions due to top loading. A container having the dome should be capable of being made from a minimum of plastic to afford efficient manufacture.

OBJECTS OF THE INVENTION

With the foregoing in mind, a primary object of the present invention is to provide a novel hot-fillable, blow-molded plastic container having a dome which in a first embodiment resists distortion, and in a second embodiment intentionally enhances distortion.

Another object of the present invention is to provide a container dome configuration capable of maintaining its structural integrity and aesthetically pleasing appearance despite the internal container pressures caused by the hot-filling process.

A further object is to provide a container having an improved dome with sufficient top loading capabilities to withstand the rigors of shipping.

A still further object is to provide a hot-fillable container with a dome configuration which is inexpensive to manufacture, structurally sound, and aesthetically appealing.

SUMMARY OF THE INVENTION

More specifically, the present invention provides a blow-molded plastic container having an improved dome structure which controls the degree of dome deformation due to hot-filling and resists dome deformation due to top loading. The container has a finish and a base remote from the finish. A lower label bumper adjacent the base and an upper label bumper spaced from the finish define a label mounting area. The dome is bell-shaped, has a peripheral waist, and extends between, and connects, the finish to the upper label bumper.

The improvement to the dome comprises at least a pair of stiffening structures, or posts, extending substantially vertically up the side of the dome from the waist to the top of the dome adjacent the finish. The stiffening structures increase the top loading capability of the container, and, depending on the number of stiffening structures used in the dome, prevent dome ovalization, or provide a controlled amount of dome ovalization.

BRIEF DESCRIPTION OF THE DRAWINGS

The foregoing and other objects, features and advantages of the present invention should become apparent from the following description when taken in conjunction with the accompanying drawings, in which:

FIG. 2 is a cross-sectional view of the reinforced dome taken along line 2—2 of FIG. 1;

FIG. 3 is a cross-sectional view of the reinforced dome taken along line 3—3 of FIG. 1;

DETAILED DESCRIPTION OF THE PREFERRED EMBODIMENT

Figure 1:
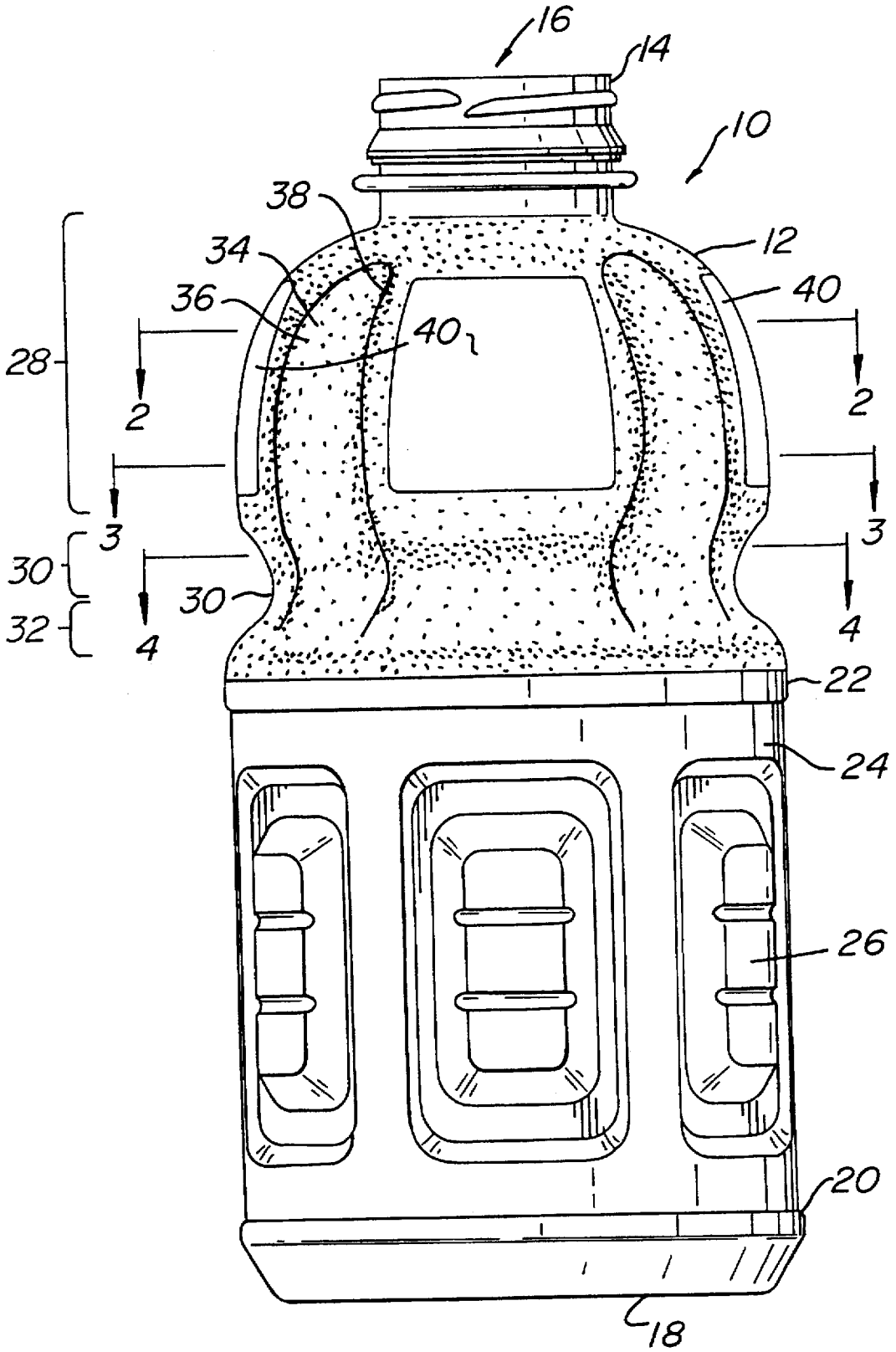
FIG. 1 is a front elevational view of a container having a reinforced dome embodying the present invention.
Figure 4:
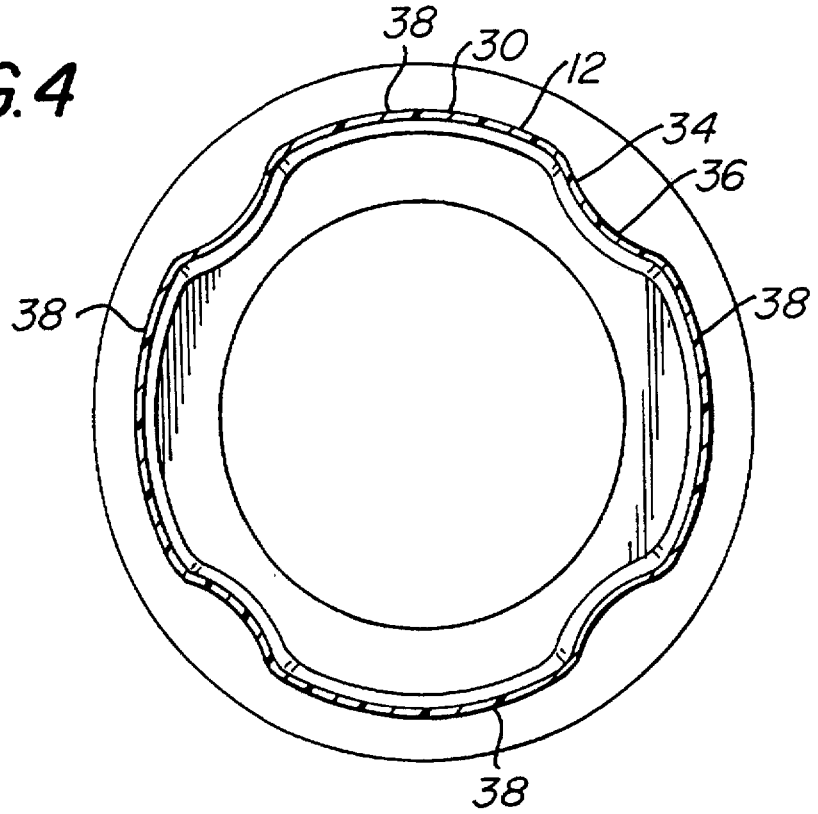
FIG. 4 is a cross-sectional view of the reinforced dome taken along line 4—4 of FIG. 1.

FIG. 1 illustrates a blow-molded plastic container 10 having a reinforced dome 12 according to the present invention. The container 10 is designed to provide an aesthetically pleasing package as well as to provide improved control of dome distortion caused by top-loading and hot-filling.

The container 10 illustrated in the drawings is an example of a container used to package beverages. More specifically, the illustrated container which will be discussed herein in detail is intended to accommodate 32 ounces of hot-fillable juice. However, the container 10 having a reinforced dome 12 according to the present invention can be used to package any number of different types of products and can be manufactured in a large range of sizes, such as eight ounces to one gallon.

The container 10 has many features which are common with known containers, such as those disclosed in the aforementioned design patents of the assignee of the present application. For instance, the container 10 has a finish 14 which provides an opening 16 for filling and receiving a closure (not shown). The container has a base 18 which is located remote from the finish 14 and which extends to a lower label bumper 20. The lower label bumper 20 and an upper label bumper 22 define the extent of a label mounting area 24. The label mounting area 24 has a series of spaced-apart vacuum flex panels 26 which accommodate volumetric changes to a hot-filled container after it has been sealed and as it cools. The dome 12 extends between the finish 14 and the upper label bumper 22.

The dome 12 of the present invention also can have some features common with known dome configurations. The dome 12, as illustrated, has a bell-shaped profile and a substantially circular horizontal cross-section. To this end, the horizontal cross-section through the dome 12, starting from beneath the finish 14, increases in diameter in an upper dome portion 28 as it extends toward the base 18. Below the upper dome portion 28, the horizontal cross-section through the dome 12 decreases to a waist 30. From the waist 30, the horizontal cross-section of the dome 26 increases in a lower dome portion 32 before it connects to the upper label bumper 22.

A unique aspect of the present invention is the additional structure in the dome 12 of the container 10 which provides the container 10 with greater top-loading capability and greater control of dome distortion. To this end, the dome 12 has at least a pair of vertically-oriented stiffening structures 34. The stiffening structures 34 can be formed as grooves, channels, ribs, or other equivalent post-like structures. The dome 12 as illustrated in FIGS. 1–5 has four equally spaced apart stiffening structures 34; however, any number including two or more stiffening structures 34 can be used in accordance with the present invention. When two stiffening structures 34 are utilized, dome distortion is enhanced; and when three or more stiffening structures 34 are utilized, dome distortion is prevented.

The preferred shape of each stiffening structure 34, as illustrated, is in the form of an inwardly concave groove 36. The grooves 36 are equally spaced apart along the periphery of the dome 12 and extend continuously from the upper dome portion 28 adjacent the finish 14 to the lower dome portion 32 adjacent the upper label bumper 22. Thus, each groove 36 extends through the waist 30. The interconnection of the groove 36 with the waist 30 aids in providing a strengthened and reinforced dome structure capable of controlling distortion of the dome.

The shape, size and location of the inwardly concave grooves 36 are best illustrated in FIGS. 2–5. The inwardly concave grooves 36 are formed at a radius of curvature "R" which can vary along the length of the grooves 36. For instance, the radius of curvature "R" as shown in FIG. 2 which is adjacent the finish 14 is greater than that represented in FIG. 3 which is adjacent the waist 30.

Figure 5:
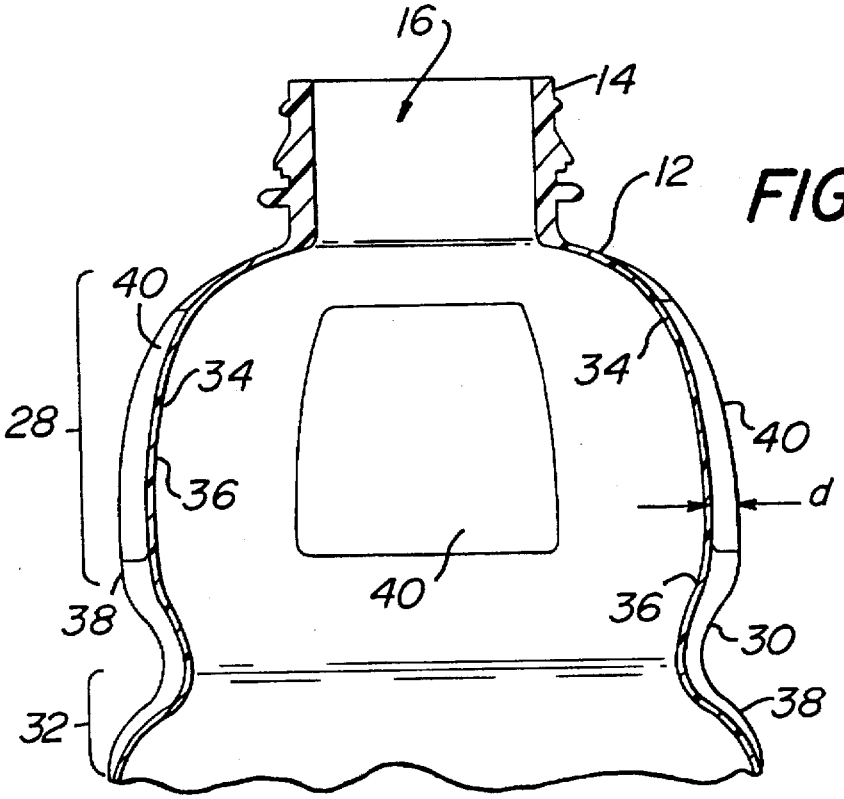
FIG. 5 is a cross-sectional view of the reinforced dome taken along line 5—5 of FIG. 2.

The inwardly concave grooves 36 also have a width "w1" and an inward depth "d" which can both vary along the length of the grooves 36. The depth "d" is best shown in FIG. 5. As shown, the depth "d" increases as the grooves extend through the upper dome portion 28 from adjacent the finish 14 and toward the waist 30. The depth "d" decreases as it extends through the waist 30 to the lower dome portion 32 adjacent the upper label bumper 22.

The peripherally spaced apart grooves 36 interrupt the dome 12 and form a plurality of arcuate lands 38, one between each pair of adjacent grooves 36. Each land 38 extends from the finish 14 to the upper label bumper 22. But for the grooves 36, the arcuate lands 38 would interconnect and provide a dome with a continuous circular horizontal cross-section. Each arcuate land 38 has a width "w2" which can vary along the length of each land 38. The width "w2" of each land 38 is greater than the width "w1" of each groove 36. Preferably, each width "w2" is at least twice that of each width "w1" at a given dome elevation, for instance, see FIGS. 2–4. Thus, a majority of the periphery of the dome is formed by the lands 38, and a minority of the periphery of the dome is formed by the grooves 36.

Each land 38 has a panel 40 which further reinforces and strengthens each land 38. Each panel 40 is located in the upper dome portion 28 completely above the waist 30. Although not illustrated in the drawings, each panel 40 can have an integral textured design formed thereon. For instance, if the container is for grape juice, the panel 40 could display a textured design of grapes, or if the container is for orange juice, the panel 40 could display a textured design of oranges. Alternatively, the design contained on the panels 40 can incorporate brand, source designations, advertising or other information, or it can simply be for artistic purposes. In addition, the dome 12 can be textured as shown in the drawings, or it can be smooth. However, the textured design of the panels 40 is preferably separate and distinct from the texture of the dome.

By way of example, and not by way of limitation, a preferred container 10 which resists distortion having a 32 ounce capacity can be made of 48 grams of PET. Such a container dome 12 has four grooves 36 and four arcuate lands 38. Each groove 36 is formed inwardly concave having a width "w1" ranging between about 0.75 and 1.0 inches, a maximum depth "d" of about 0.2 inches, and a radius of curvature "R" ranging between about 0.25 to 0.5 inches. Each land 38 has a width "w2" ranging between 1.25 to 2.0 inches. The dome 12 of the container 10 resists distortion, particularly ovalization, with hot-fill temperatures ranging up to 185° F. and top loading of up to 60 pounds.

The four grooves 36 in the dome 12 illustrated in FIGS. 1–5 function to resist dome ovalization distortion caused by hot-filling and top-loading. A similar result is achieved with the use of three or more equally spaced apart grooves 36 in a dome structure.

In certain container designs, a degree of ovalization of a dome formed with a circular cross-section may be preferred. For instance, the ovalization distortion can be utilized to provide additional relief of volumetric changes to a hot-filled container and to provide a broader area for graphics on the lands of the dome.

Figure 6:
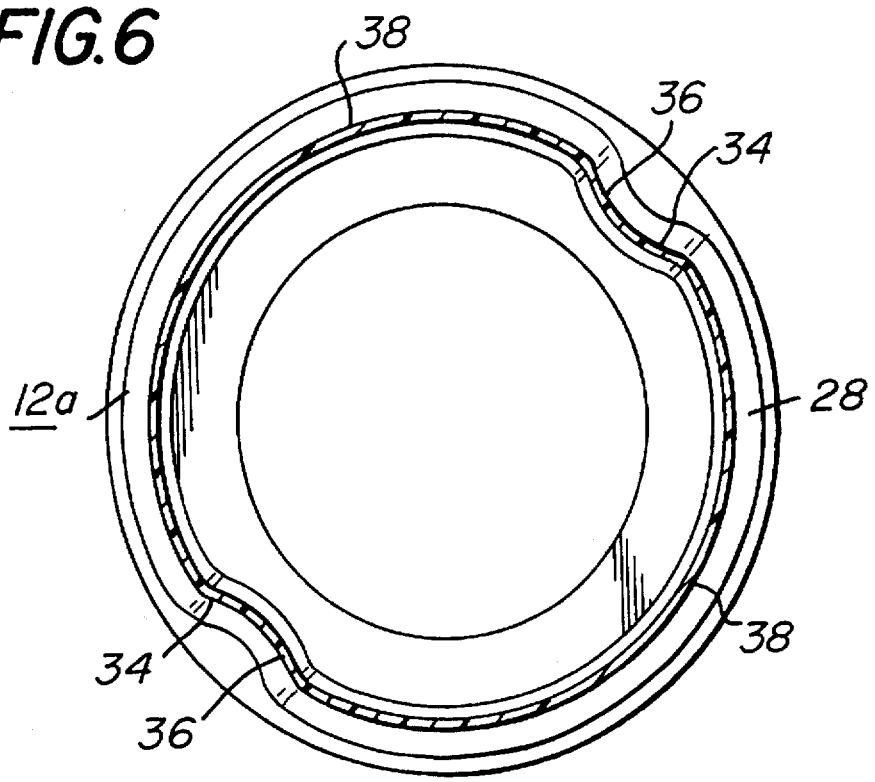
FIG. 6 is a cross-sectional view of an alternate embodiment of a dome before it has been hot-filled.
Figure 7:
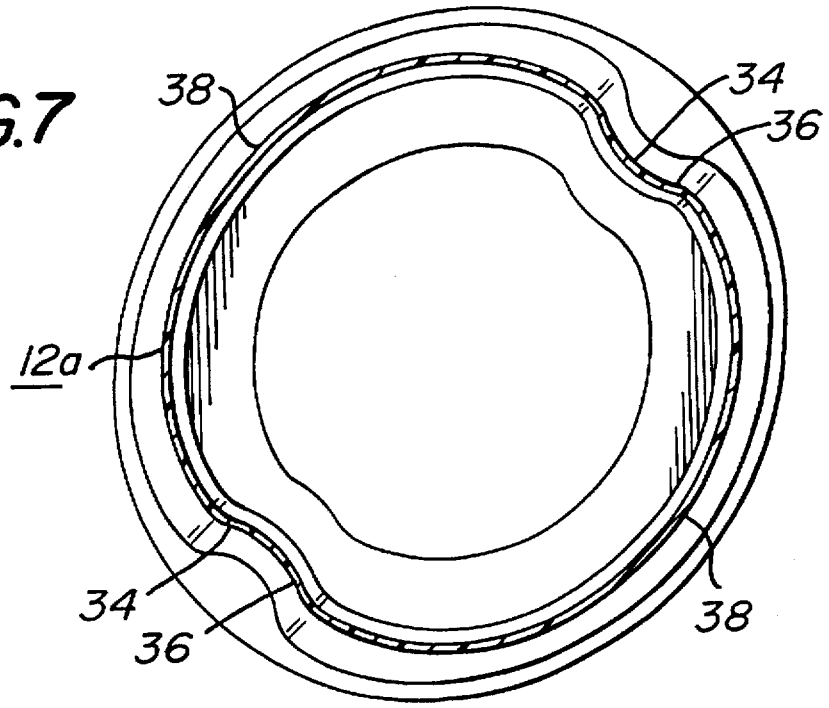
FIG. 7 is a cross-sectional view of the alternate embodiment of the dome of FIG. 6 after it has been hot-filled.

As shown in FIGS. 6 and 7, the use of two grooves 36 on opposite sides of a dome 12*a* enhances in a controlled manner the distortion of the dome along the axis of the grooves 36. FIG. 6 illustrates the substantially circular cross-sectional configuration of the dome 12*a* as blow-molded. After the container is hot-filled, capped, and cooled, the dome 12*a* ovalizes as a result of the volumetric changes of the container. See FIG. 7. The grooves 36 control the ovalization so that the distortion can be readily replicated on all similarly formed containers. Thus, the dome 12*a* provides a hot-fillable container with a reproducible aesthetically pleasing appearance and a sturdy, reinforced dome structure.

The described containers having a reinforced dome afford enhanced top loading capability and controlled dome ovalization. The containers can be efficiently and inexpensively blow-molded from any of several commercially available plastics.

While preferred containers have been described in detail, various modifications, alterations, and changes may be made without departing from the spirit and scope of the present invention as defined in the appended claims.

We claim:

1. In a blow-molded plastic container having a finish providing an opening, a base remote from the finish, a label mounting area connected to the base, and a dome extending between and connecting the finish to the label mounting area, the improvement comprising at least two identical and equally spaced apart stiffening structures located in the dome, said stiffening structures extending continuously and substantially vertically throughout substantially the entire vertical extent of the dome from about the label mounting area to about the finish, wherein each of said stiffening structures is formed by an inwardly concave groove, and wherein an arcuate convex land is located between and connects to each pair of adjacent stiffening structures, each of said lands being identical and providing the dome with a substantially circular horizontal cross-section, whereby said stiffening structures control distortion of the dome and increase top loading capability.

2. A blow-molded plastic container according to claim 1, wherein the dome is bell-shaped and has an inwardly extending peripheral waist.

3. A blow-molded plastic container according to claim 2, wherein said stiffening structures extend through said waist.

4. A blow-molded plastic container according to claim 1, wherein the dome has at least three of said stiffening structures, whereby said stiffening structures prevent ovalization of the dome.

5. A blow-molded plastic container according to claim 4, wherein the container has at least one vacuum flex panel located below the dome so that the container is useable in hot-fill beverage processing, and wherein said at least three stiffening structures reinforce the dome and prevent distortion due to volumetric changes of the container caused by hot-fill processing.

6. A blow-molded plastic container according to claim 1, wherein the dome has only two stiffening structures, whereby said two stiffening structures enhance controlled ovalization distortion.

7. A blow-molded plastic container according to claim 1, wherein said grooves have a width and said lands have a width, and wherein said groove width is equal to at least about ⅓ said land width.

8. A blow-molded plastic container according to claim 1, wherein said dome has an odd number of stiffening structures.

9. In a hot-fillable, blow-molded plastic container having a finish providing an opening, a base remote from the finish, a lower label bumper adjacent the base and an upper label bumper spaced from the finish defining a label mounting area, and a bell-shaped dome having a height and extending between and connecting the finish to the upper label bumper, the dome being blow-molded with a substantially circular horizontal cross-section throughout its height and having an inwardly extending peripheral waist, the improvement comprising a plurality of stiffening structures located on the dome, each of said stiffening structures being an inwardly-concave, vertically-oriented groove which extends continuously through substantially the entire height of the dome from below the waist to adjacent the finish, said stiffening structures being laterally and equally spaced apart along the periphery of the dome and extending through the waist, whereby said stiffening structures control ovalization distortion of the dome.

10. A hot-fillable, blow-molded plastic container according to claim 9, wherein each adjacent pair of said stiffening structures are connected by an arcuate convex land such that the dome is formed by an alternating pattern of said plurality of stiffening structures and a plurality of arcuate lands, and wherein said arcuate lands provide the dome as blow-molded with a substantially circular horizontal cross-sectioned appearance.

11. A hot-fillable, blow-molded plastic container according to claim 10, wherein each of said arcuate lands has a panel located entirely above the waist.

12. A hot-fillable, blow-molded plastic container according to claim 10, wherein a majority of the periphery of the dome is formed by said lands, and a minority of the periphery of the dome is formed by said grooves.

13. A hot-fillable, blow-molded plastic container according to claim 12, wherein said majority of the periphery of the dome formed by said lands is at least double that of said minority of the periphery of the dome formed by said grooves.

14. A hot-fillable, blow-molded plastic container according to claim 13, wherein the dome has at least three grooves whereby said at least three grooves resist dome ovalization.

15. A hot-fillable, blow-molded plastic container according to claim 13, wherein the dome has only two grooves, whereby said two grooves enhance dome ovalization.

16. A hot-fillable, blow-molded plastic container according to claim 10, wherein each of said inwardly concave grooves has a maximum depth at least 0.2 inches, and wherein each of said inwardly concave grooves is defined by a radius of curvature.

17. In a hot-fillable, blow-molded plastic container for packaging beverages, the container having a finish providing an opening, a base remote from the finish, a lower peripheral label bumper adjacent the base and an upper peripheral label bumper spaced from the finish defining a peripheral label mounting area, and a bell-shaped dome extending between and connecting the finish to the upper peripheral label bumper, the peripheral label mounting area having at least one vacuum flex panels for accommodating volumetric changes of the container due to hot-filling, the bell-shaped dome having a height and an inwardly extending waist, and the base, label mounting area and dome having a substantially circular horizontal cross-section, the improvement comprising four equally spaced apart vertical stiffening structures located on the dome and extending through the waist, each of said stiffening structures being formed by an inwardly concave groove which extends continuously throughout substantially the entire height of the dome from below the waist to adjacent the finish, adjacent grooves being separated by identical arcuate lands, whereby said grooves and the waist cooperate to control ovalization of the dome and resist distortion due to top loading.

* * * * *